US007124915B2

(12) United States Patent
Restive

(10) Patent No.: US 7,124,915 B2
(45) Date of Patent: Oct. 24, 2006

(54) HANDLE ASSEMBLY FOR PROVIDING A CONTROLLABLE DISCHARGE STREAM DIRECTION FROM A PRESSURE CONTAINER WHILE MAINTAINING A STABLE CENTER OF MASS OF THE PRESSURE CONTAINER

(75) Inventor: Mario J. Restive, New York Mills, NY (US)

(73) Assignee: The Fountainhead Group, Inc., New York Mills, NY (US)

( * ) Notice: Subject to any disclaimer, the term of this patent is extended or adjusted under 35 U.S.C. 154(b) by 0 days.

(21) Appl. No.: 10/862,918

(22) Filed: Jun. 7, 2004

(65) Prior Publication Data

US 2005/0269363 A1 Dec. 8, 2005

(51) Int. Cl.
*B67B 5/00* (2006.01)
*B65D 83/20* (2006.01)
*B65D 83/40* (2006.01)

(52) U.S. Cl. ..... 222/153.11; 222/402.13; 222/402.15; 222/469; 222/472; 222/537

(58) Field of Classification Search ..... 222/153.09, 222/153.1, 153.11, 402.1, 402.13, 402.15, 222/469, 470, 472, 526, 537; 16/430, 900; 239/525, 526, 537, 587.1, 587.5, 587.6
See application file for complete search history.

(56) References Cited

U.S. PATENT DOCUMENTS 2,899,108 A * 8/1959 Knapp ..... 222/151
3,116,856 A * 1/1964 Prussin et al. ..... 222/402.24
3,148,806 A * 9/1964 Meshberg ..... 222/402.11
3,221,950 A * 12/1965 O'Donnell ..... 222/402.11
3,402,862 A * 9/1968 Meshberg ..... 222/402.11
3,428,224 A * 2/1969 Douglas et al. ..... 222/402.13
4,067,482 A * 1/1978 Vogel et al. ..... 222/153.11
4,449,647 A * 5/1984 Reed et al. ..... 222/153.09
4,505,335 A * 3/1985 Hayba ..... 169/76
4,690,312 A * 9/1987 Crapser et al. ..... 222/402.17
5,501,375 A * 3/1996 Nilson ..... 222/402.13
6,073,815 A * 6/2000 Ponton ..... 222/402.21
6,105,826 A * 8/2000 Oursin et al. ..... 222/153.06
6,513,684 B1 * 2/2003 Bougamont et al. ..... 222/548
6,592,057 B1 7/2003 Erickson et al.
6,726,129 B1 4/2004 Kao
6,732,958 B1 5/2004 Norville et al.
6,796,464 B1 * 9/2004 Tung ..... 222/402.17
2004/0222246 A1 * 11/2004 Bates et al. ..... 222/402.15

* cited by examiner

*Primary Examiner*—Joseph A. Kaufman
(74) *Attorney, Agent, or Firm*—Brian B. Shaw, Esq.; Stephen B. Salai, Esq.; Harter Secrest & Emery LLP

(57) ABSTRACT

A handle assembly for engaging a pressure container having an outlet valve, the handle assembly including a base for engaging the pressure container and a handle pivotally connected to the base so as to locate the pivotal connection at least proximal to a vertical projection of a center of mass of the pressure container. The handle assembly also includes a flow control mechanism for continuous operable engagement with the outlet valve independent of the orientation of the handle and the container about a pivot axis.

12 Claims, 5 Drawing Sheets

HANDLE ASSEMBLY FOR PROVIDING A CONTROLLABLE DISCHARGE STREAM DIRECTION FROM A PRESSURE CONTAINER WHILE MAINTAINING A STABLE CENTER OF MASS OF THE PRESSURE CONTAINER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to dispensing material from a pressure container having an outlet valve, and more particularly, to a handle assembly for selectively fluidly interconnecting the outlet valve to a nozzle in the handle assembly by means of a handle pivotally connected relative to the pressure container.

2. Description of Related Art

Pressure containers are used for the application of a wide variety of materials to work pieces or the environment. For example, pressure containers are often used in conjunction with both commercial and amateur gardeners to apply pesticides, herbicides, insecticides. Pressure containers are also used in the conjunction with the application of cleaning materials. However, many of these pesticides, herbicides, insecticides and solvents can be toxic to humans and thus require limited contact with humans. Therefore, the mechanism for releasing the material from the pressure container can be critical to maintaining a clean, healthy, and safe work environment.

There are a number of different configurations of conventional sprayers for use with pressure containers. For instance, pistol-shaped or linear shaped handles are popular configurations. In each of these configurations, the direction of the emitted spray is fixed relative to the pressure container. To apply the material as desired, the nozzle (and hence entire pressure container) must be reoriented to redirect the spray. As a consequence, the user may be required to contort their arm or wrist to direct the spray to a particular location, such as near the user's feet or an elevated location. As the entire pressure container, and any remaining contents, must be reoriented, this movement of such weight becomes extremely taxing to the user. Further, holding the arm and wrist in contorted positions can be uncomfortable and extremely tiresome, particularly if the position must be maintained for a period of time. This fatigue and inconvenience are magnified to elderly or arthritic users, who may comprise a large percentage of hobby gardeners. Also, the fatigue may be exacerbated when fluids are emitted from a spray nozzle with significant force.

Further, as user control decreases with increasing fatigue, the application of the material becomes less controlled and hence undesirable contact with the user can increase. Therefore, frequent users can develop serious health problems such as carpal tunnel syndrome as well as conditions associated with over exposure to potentially harmful chemicals.

Therefore, the need exists for an applicator handle assembly that can be comfortably held by a user while the associated spray is directed to a desired location without requiring excessive reorientation of the pressure container. A need also exists for an applicator handle assembly that enables the user to select from a wide range of spray directions without uncomfortable repositioning of the pressure container.

BRIEF SUMMARY OF THE INVENTION

The present invention provides a handle assembly for engaging a pressure container to selectively release material from the container as a discharge stream, wherein a reorientation of the center of mass of the container is not required to change direction of the discharge flow.

In one configuration, a handle is continuously pivotable with respect to the pressure container through a predetermined range of motion, such that the location of the center of mass of the pressure container remains substantially constant throughout the range of motion of the handle.

In a further configuration, the center of mass of the pressure container is disposed along a given axis, wherein a pivot connection between the handle and the pressure container is substantially adjacent to or on the given axis.

The present handle assembly engages the pressure container for selectively actuating an outlet valve of the container. The handle assembly includes a base having a container engaging portion for retaining the base relative to the container, wherein the engagement of the base and the pressure container can be releasable or effectively permanent. The handle assembly further includes a handle pivotally connected to the base at a pivot point, such that the handle is movable between at least a first orientation relative to the base and a second orientation relative to the base, wherein the handle includes a grip for grasping by a user to control manipulate the handle assembly and the pressure container, a nozzle and a dispensing button connected to the outlet valve for selectively opening the outlet valve to pass pressurized contents from the container and through the nozzle.

BRIEF DESCRIPTION OF THE SEVERAL VIEWS OF THE DRAWING(S)

DETAILED DESCRIPTION OF THE INVENTION

Figure 1:
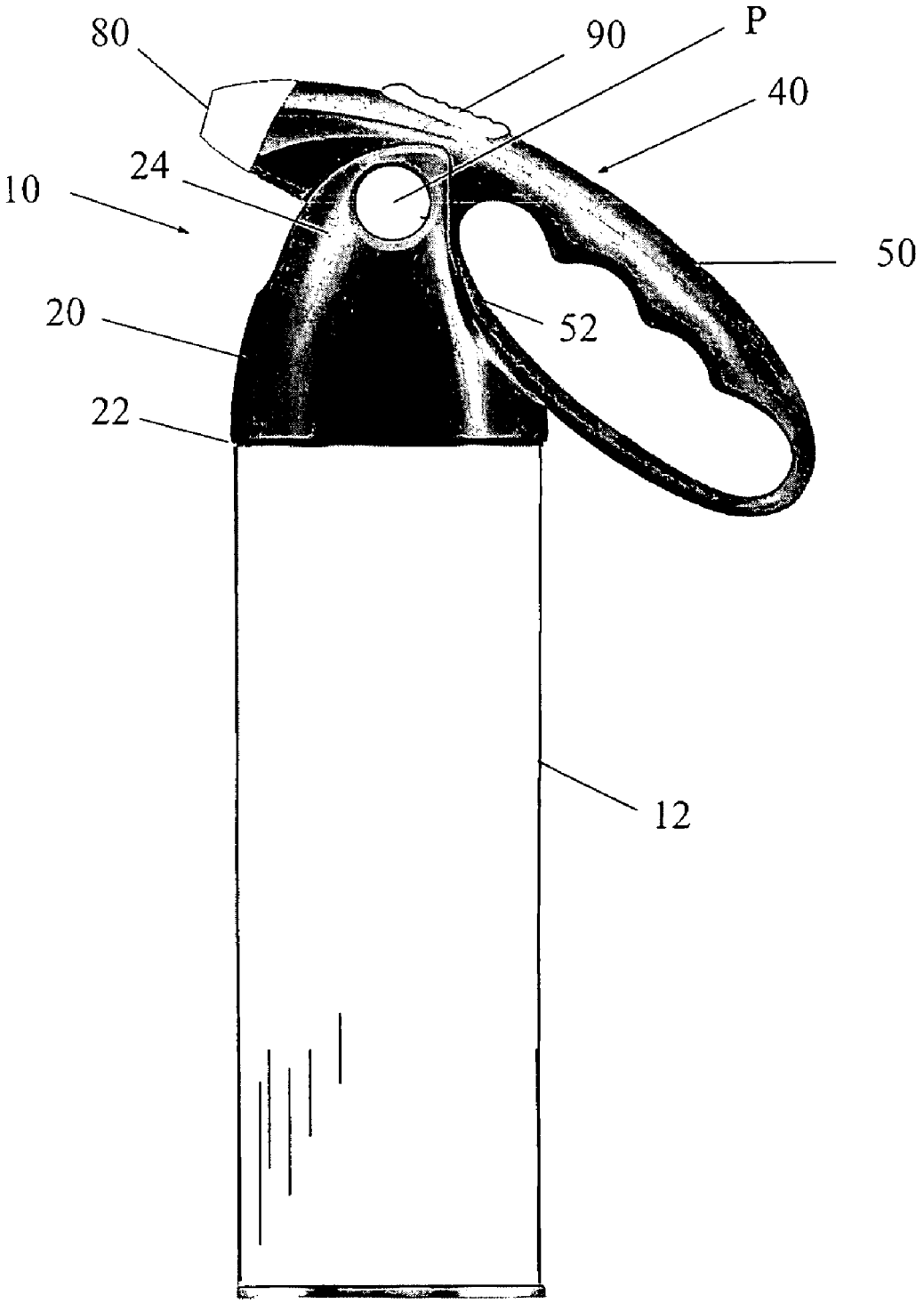
FIG. 1 is a side elevational view of a first configuration of the handle assembly.
Figure 2:
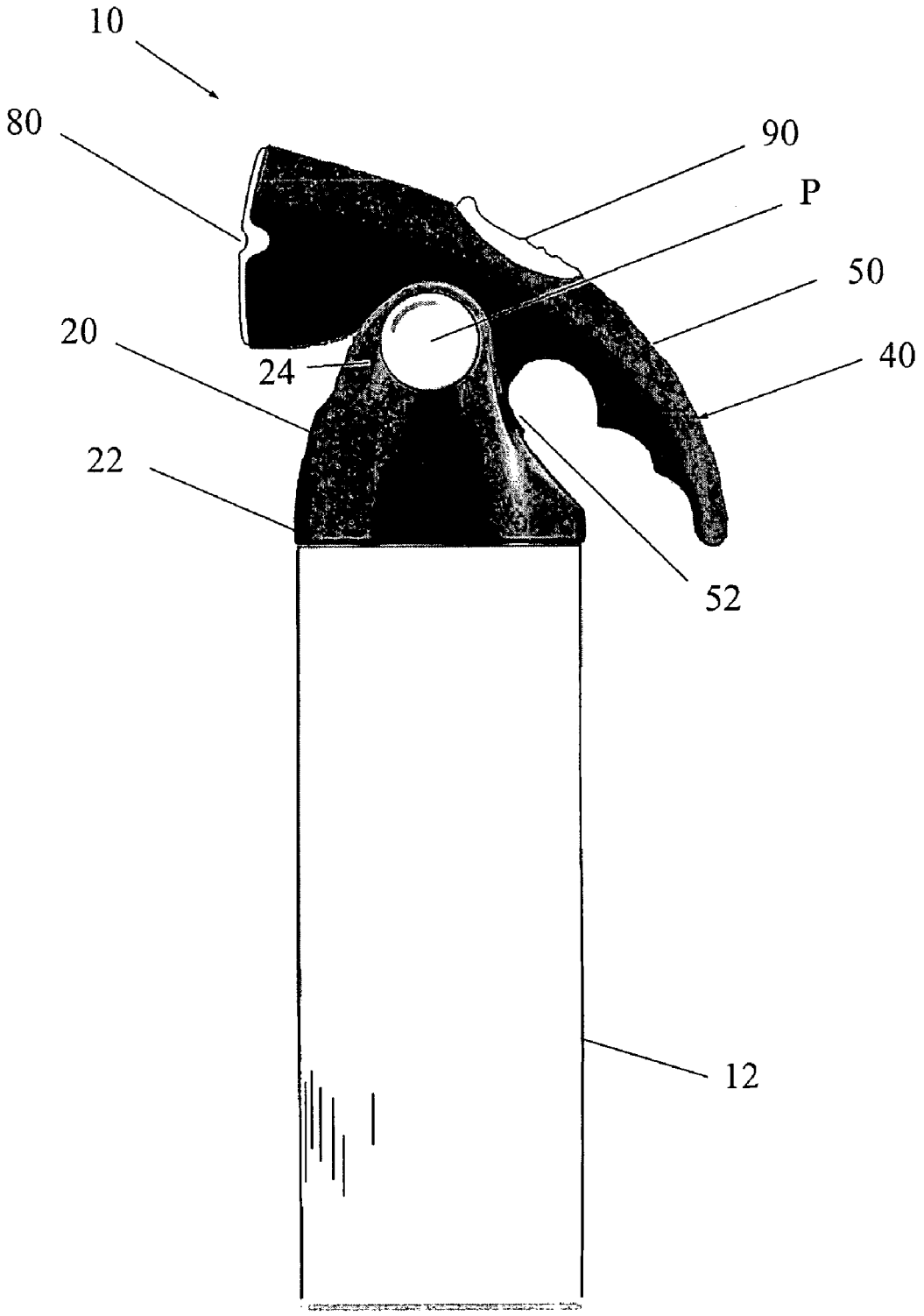
FIG. 2 is a side elevational view of a second configuration of the handle assembly.
Figure 3:
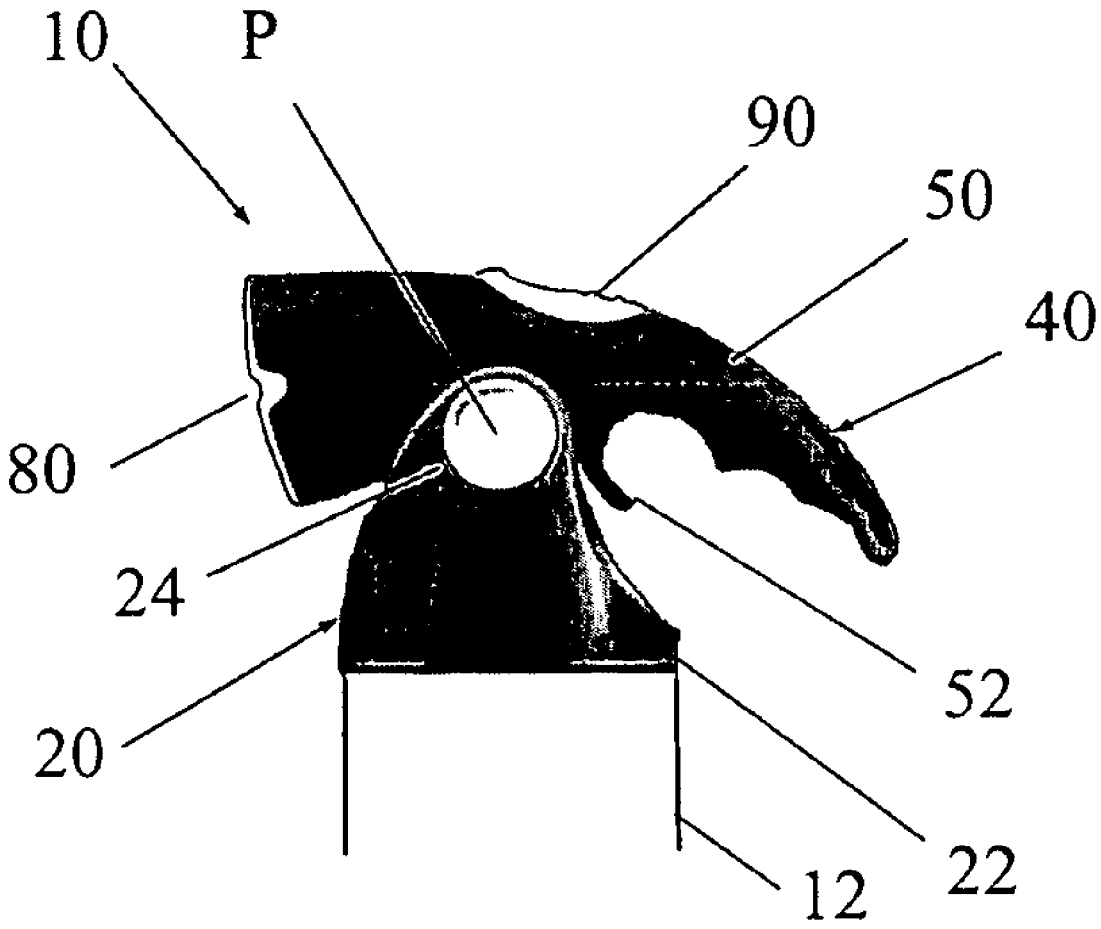
FIG. 3 is an enlarged side elevational view of a portion of the second configuration of the handle assembly in a slightly different orientation.
Figure 4:
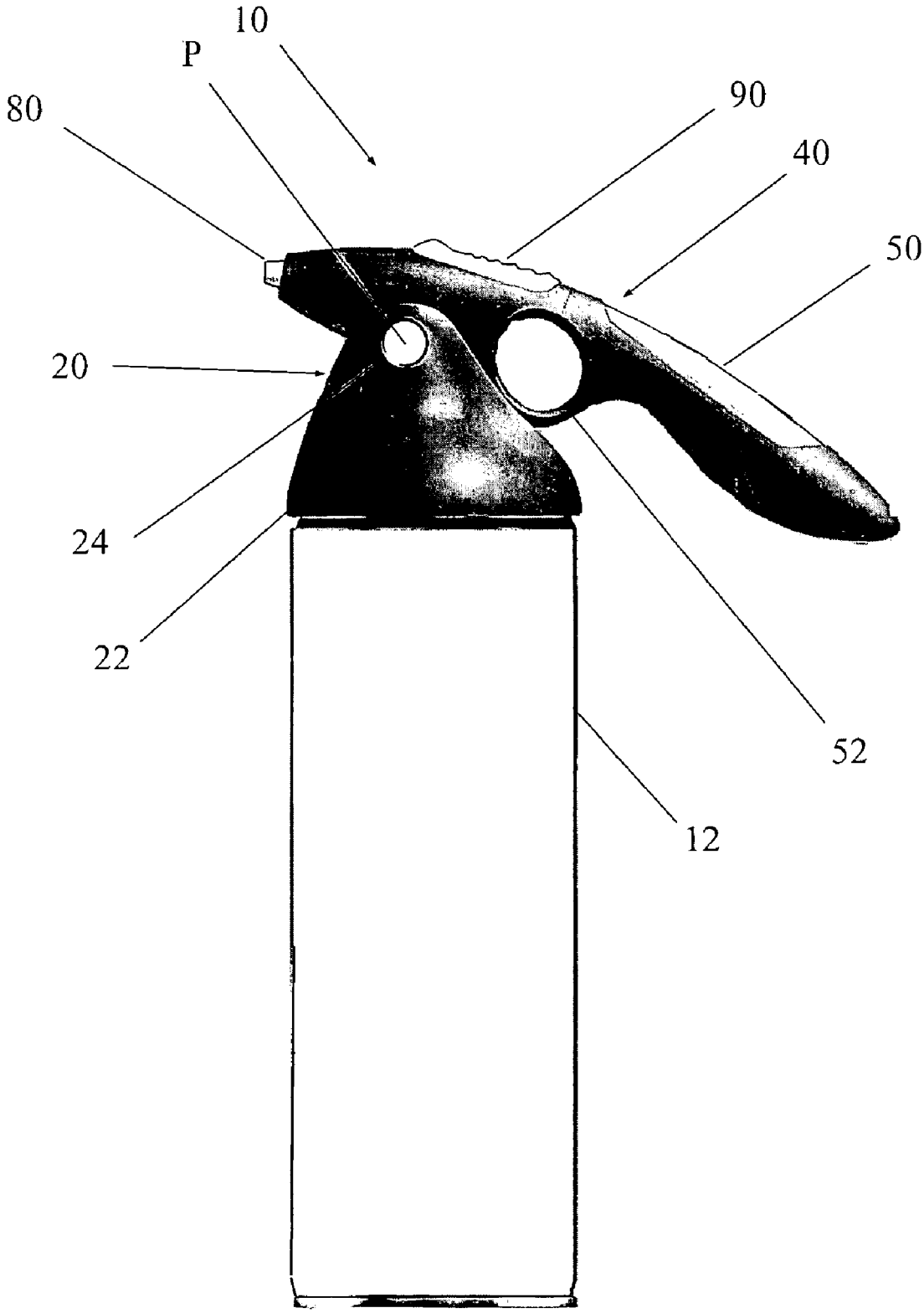
FIG. 4 is a side elevational view of a third configuration of the handle assembly.
Figure 5:
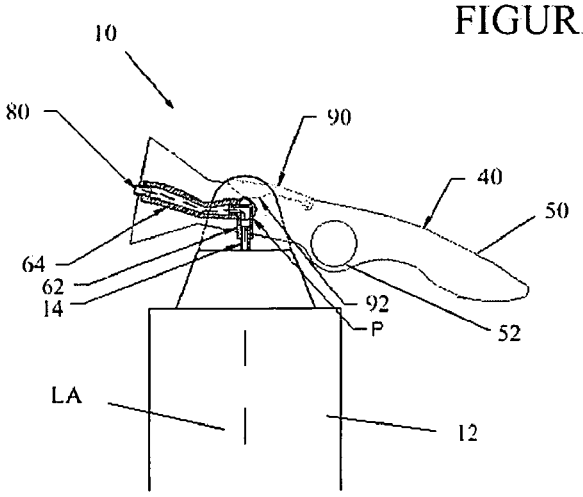
FIG. 5 is a cross sectional view of the flow control mechanism in the handle assembly in a first, generally horizontal, position relative to the pressure container.
Figure 6:
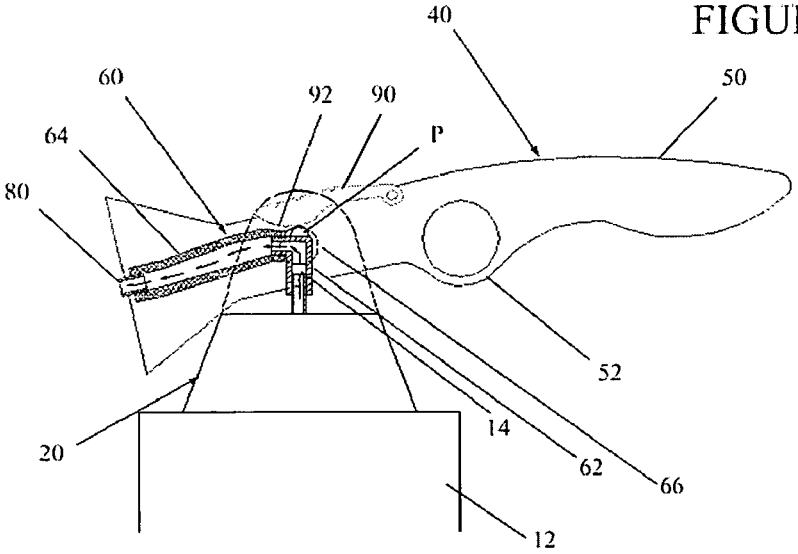
FIG. 6 is a cross sectional view of the flow control mechanism in the handle assembly in a second, generally downward, position relative to the pressure container.
Figure 7:
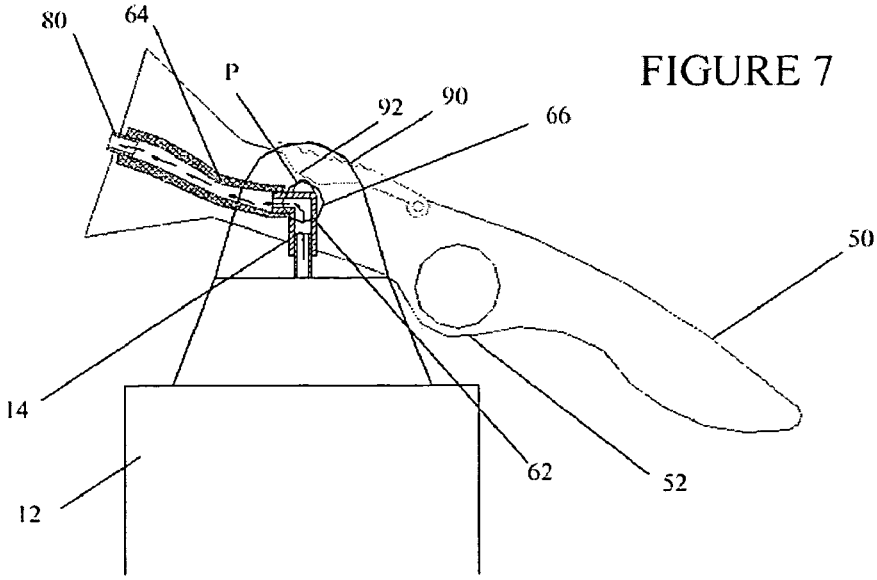
FIG. 7 is a cross sectional view of the flow control mechanism in the handle assembly in a third, generally upward, position relative to the pressure container.

Referring to FIGS. 1–7, the applicator handle assembly 10 of the present invention is used in conjunction with a pressure container 12.

The pressure container 12 can be any of a variety of containers including metal, plastic, composite or laminate. The pressure container 12 is sized to retain a volume of material to be distributed or applied by a user. Typically, the material to be distributed or applied is a liquid or liquid mixture. Pressurization of the container 12 can be provided by any of a variety of mechanisms including an original manufacturer of the container, such as an aerosol container, or through user actuation, such as by a connected or integral pump. Further, the pressure container 12 can be single use or reusable. The pressure container 12 is typically of a size that can be readily carried by a single arm (hand) of the user. The pressure container 12 includes an outlet valve 14 for selectively passing the pressurized material from the container.

For purposes of description, the pressure container 12 is described in terms of an aerosol container (often referred to as a bottle). In the present example of the pressure container 10 as an aerosol can, the container has a generally cylindrical body defining a longitudinal axis LA, seen in FIGS. 5–7. In certain configurations, the pressure container 12 also includes a peripheral flange or shoulder at an upper end of the cylindrical body. The structure and functioning of an aerosol can is well-known in the art.

The pressure container 12 further includes a center of mass, wherein the center of mass is preferably located on the longitudinal axis LA. It is further preferable that the center of mass of the pressure container 12 remain on or adjacent the longitudinal axis as the material is released from the container. However, it is understood the center of mass can be spaced from the longitudinal axis. In addition, the pressure container 12 has a footprint defined by a cross section of the of the container. Thus, the footprint is a vertical projection of the cross section of the pressure container 12.

The pressure container 12 can include any of a variety of materials for selective discharge. For example, the pressure container 12 can include premixed or user mixed chemical compositions. In some applications, the pressure container 12 is provided to the user in a pressurized and loaded state. Alternatively, the pressure container 12 can be loaded or filled by the user and subsequently pressurized. Typically, the specific loaded and/or pressurized state of the pressure container 12 is at least partially dictated by the intended material to be dispensed.

The applicator handle assembly 10 includes a base 20, a handle 40 and a flow control assembly 60.

The base 20 includes an engaging portion 22 for engaging or coupling to the pressure container 12. The engaging portion 22 can have any of a variety of configurations including detents, friction fits, threads, snap locks or bayonet connections. In one configuration, to engage the aerosol container 12, the base 20 includes a depending peripheral shoulder or flange for snap fitting about the corresponding flange or shoulder on the container. It is also understood that secondary fasteners can be employed to secure the base 20, and hence the handle assembly 10, to the pressure container 12. Thus, the base 20 becomes fixed relative to the pressure container 12, and any reorientation of the container requires a corresponding reorientation of the base. The engaging portion 22 can be constructed to provide releasable engagement with the pressure container 12, thereby allowing for reuse of the handle assembly 10. Alternatively, the engagement of the base 20 to the pressure container 12 can be effectively permanent, thereby precluding non destructive separation of the handle assembly 10 from the pressure container.

The base 20 includes a mount 24 for connecting to the handle 40. Preferably, the handle 40 is pivotally connected to the base 20, such that the handle can rotate about a pivot axis P, relative to the base. The mount 24 and the handle 40 are constructed to provide a pivotal connection, wherein the handle 40 is pivotally connected to the base 20 to be movable between at least a first orientation and a second orientation with respect to the base.

The pivotal connection of the handle 40 to the base 20 can provide for a fixed number of predetermined orientations, for example as by employing interlocking surfaces including a plurality of intermeshing teeth between the base in the handle. Alternatively, the pivotal connection can provide for an infinite number of positions, so as to provide a continuous adjustment of the orientation of the handle 40 relative to the base 20. The pivoting connection can be provided by any of a variety of constructions, including but not limited to, apertures in each of the mount 24 and the handle 40 with a pivot pin located in the apertures; projecting tabs or spindles on either the mount or the handle with corresponding recesses on the other of the mount or the handle, or a guide slot in either the mount or the handle and a corresponding pin on the other of the mount or handle.

In one configuration, the handle 40 can pivot approximately 90° relative to the base 20. In a further configuration, the handle 40 can pivot from a first location locating the nozzle 80 substantially perpendicular to the longitudinal axis of the pressure container 12 to an angle approximately 45° below perpendicular and approximately 45° above perpendicular.

The pivotal connection of the handle 40 to the base 20 is selected to be within the footprint of the pressure container 12. That is, a vertical projection of a cross-section of the pressure container 12 preferably encompasses the pivot point (or vertical projection of the pivot axis). In a further configuration, wherein a vertical line is drawn through a center of mass of the pressure container 12, the pivot point (pivot axis) is substantially adjacent, coincident or intersects the vertical line. In those configurations of the pressure container 12 being substantially cylindrical, the vertical line is coincident with the longitudinal axis LA of the container. Preferably, the pivot axis of the handle assembly 10 lies on a vertical projection of the center of mass of the pressure container 12.

However, it is contemplated the pressure container 12 can have any of a variety of vertical and horizontal cross sections which may or may not be symmetrical. A preferred configuration, as the contents of the pressure container 12 are discharged, the center of mass of the container travels along a linear path. However, is understood the migration of the center of mass can follow a slightly curvilinear or arcuate path. In each of these configurations, it is preferred the pivot axis be substantially adjacent or intersecting the vertical projection of the center of mass of the pressure container 12.

The handle 40 includes a grip 50, a nozzle 80 and a dispensing button 90. In a preferred configuration, the handle 40 is an integral unit such that the grip 50, the nozzle 80 and the dispensing button 90 are in a fixed relative to each other. Thus, the discharge stream from the nozzle 80 remains in a constant orientation relative the grip 50, and therefore the nozzle 80 always points in the direction of the handle 40. As this orientation of the nozzle 80 (and hence discharge stream) and handle 40 is generally intuitive, it is believed this constant relation reduces unintended misdirection of the discharge stream.

As seen in FIGS. 1–4, the grip 50 can have any of a variety of configurations to be grasped by the user. Preferably, the grip 50 is configured to dispose an upper surface of the grip within the palm of the hand such that at least the index (first) finger, the middle (second) finger and the ring (third) finger are below the grip and the thumb of the user is disposed along an upper surface of the grip. As seen in the FIGS. 1–7, the thumb is disposed adjacent or resting upon the dispensing button 90. It is also understood that the grip 50 can be size to locate a portion of all four fingers below the grip.

In addition, the grip 50 includes a finger guard 52 adjacent the location of at least the first finger. The finger guard 52 is spaced from a lower surface of the grip 50 to locate the portion of the first finger intermediate the finger guard and the bottom surface of the grip. The finger guard 52 is sized to reduce pinching of the fingers between the grip 50 and the base 20 as the handle 40 rotates relative to the base.

The nozzle 80 of the handle 40 is spaced from the grip 50. The nozzle 80 can be constructed provided to form any of a variety of application patterns including sprays, mists, streams, or jets as well as fogging. The particular pattern is determined in part by the chemical to be applied, the available volume and the available motive pressure. It is intended that the nozzle 80 remains in a fixed orientation with the handle 40 and hence the grip 50. However, it is understood there can be relative adjustment between the nozzle 80 and the grip 50, without departing from the present invention.

The flow control assembly 60 fluidly interconnects the outlet valve 14 of the pressure container 12 to the nozzle 80. The flow control assembly 60 includes a discharge passageway having an elbow 62 for interconnecting to the outlet valve 14 and a flexible duct 64 interconnecting the elbow and the nozzle 80. The elbow 62 is connected to the outlet valve 14 of the pressure container 12, so that vertical motion of the elbow opens the outlet valve. While the present configuration is described in terms of vertical actuation of the outlet valve 14, it is understood the outlet valve can be constructed so that a lateral motion (relative to the longitudinal axis) can be used to actuate the outlet valve. In one configuration, the elbow 62 is a substantially rigid material, such as a hard plastic, including thermoplastic, thermoplastic elastomers or hard thermosets. The elbow 62 includes or is fixedly connected to a cam follower 66, which extends above or adjacent to the elbow 62.

The flexible duct 64 has sufficient flexibility to allow for rotation of the handle 40 relative to the base 20 (and pressure container 12), yet also has sufficient stiffness to preclude kinking or substantial flow restriction through the flexible duct. Advantageously, the end of the elbow 62 and the flexible duct 64 are sized so that the connection of the flexible duct to the elbow is proximal to the pivot axis. As the connection of the flexible duct 64 to the elbow 62 is adjacent or at the pivot axis, deformation of the flexible duct upon rotation of the handle 40 relative to the base 20 is minimized.

Alternatively, the flexible duct 64 can include a curvilinear portion defining a generally constant radius which is concentric with the pivot axis (or pivot point). Thus, upon rotation of the handle 40 relative to the base 20 the flexible duct 64 is not deformed and dispensing from the pressurize container 12 is not inhibited or degraded.

The dispensing button 90 includes cam 92 for contacting the cam follower 66 connected to the elbow 62 to selectively actuate the outlet valve 14, thereby permitting the pressurized contents to pass from the pressure container 12. The cam 92 and the cam follower 66 are sized to contact upon depressing the dispensing button 90 relative to the grip 50.

The cam 92 and the cam follower 66 are also configured to maintain a constant depression/force on the dispensing button 90 as the handle 40 is rotated relative to the base 20. That is, the force on the dispensing button 90 required to open the outlet valve 14 is preferably independent of the orientation of the handle 40 to the base 20 (and hence pressure container 12) Therefore, upon depressing the dispensing button 90, the cam 92 and the cam follower 66 are in operable contact throughout the full range of motion between the handle 40 and the base 20.

It is understood the dispensing button 90 (and cam 92) and the cam follower 66 can be sized so that any depression of the dispensing button 90 opens the outlet valve 14. Alternatively, a certain amount of movement of the dispensing button 90 can be required to contact the cam 92 and cam follower 66, before the outlet valve 14 is opened. However, alternative connections of the dispensing button 90 to the outlet valve 14 can be employed.

Thus, the present handle assembly 10 provides for a selectively actuated release of material from the container 12, wherein the hand of the user is spaced from the nozzle 80 so as to enhance separation of the user from the discharge stream.

Further, as the thumb is used for actuating the dispensing button 90, and hence the outlet valve 14 of the pressure container 12, less fatigue is experienced by the user, as compared to those devices requiring finger actuation.

The pivoting of the handle 40 relative to the pressure container 12, and particularly the ability to pivot the handle without significant movement of the center of mass of the pressure container substantially reduces user fatigue.

A further advantage of the handle assembly 10 arises from the pressure container 12 remaining in a substantially upright orientation, independent of the discharge stream being directed upward or downward. That is, many pressure containers 12 employ a dip tube which extends to the bottom of the container, so that material is expressed from the container through the dip tube. If the pressure container 12 is tipped from vertical, the liquid in the container can flow away from the dip tube, thereby interrupting the discharge stream. Traditionally, the pressure container 12 is tilted to provide an upward or downward discharge stream, thereby causing the dip tube to be out of the available liquid in the container, and hence adversely impacting the discharge stream. However, as the present handle assembly 10 can provide upward and downward discharge streams without requiring tilting of the pressure container 12, the dip tube will remain in operable contact with the available liquid longer than those containers requiring a tilting of the container to achieve an upward or downward discharge stream, thereby providing a less interrupted discharge stream.

While the invention has been described in connection with a presently preferred embodiment thereof, those skilled in the art will recognize that many modifications and changes made be made therein without departing from the true spirit and scope of the invention, which accordingly is intended to be defined solely by the appended claims.

The invention claimed is:

1. A handle assembly for engaging a pressure container and selectively actuating an outlet valve of the pressure container, the handle assembly comprising:

a) a base having a pressure container engaging portion for retaining the base relative to the pressure container; and b) a handle pivotally connected to the base on a pivot axis and movable between at least a first orientation relative to the base and a second orientation relative to the base, the handle including a pressure container lifting grip for grasping by a user to lift the pressure container and to manipulate the handle relative to the pressure container by pivoting the handle about the pivot axis, a nozzle and a dispensing button connected to the outlet valve for selectively opening the outlet valve to pass pressurized contents from the pressure container and through the nozzle. the pivot axis being horizontally intermediate the pressure container lifting grip and the nozzle.

2. The handle assembly of claim 1, wherein the pressure container includes a center of mass and the pivot axis is located to dispose the center of mass substantially directly below the pivot point.

3. The handle assembly of claim 1, wherein the pivot axis and the center of mass of the pressure container are substantially vertically aligned.

4. The handle assembly of claim 1, further comprising a flexible duct extending between the outlet valve and the nozzle.

5. The handle assembly of claim 4, wherein an end of the flexible duct is substantially adjacent the pivot point.

6. The handle assembly of claim 1, wherein the pressure container defines a footprint and the pivot axis is located within a vertical projection of the footprint.

7. The handle assembly of claim 1, wherein the pressure container includes a longitudinal axis and a center of mass of the pressure container is located along the longitudinal axis, and the pivot axis is substantially adjacent the longitudinal axis.

8. The handle assembly of claim 1, wherein the nozzle is configured to create a discharge stream in a dispersive pattern.

9. A handle assembly for engaging a pressure container and selectively actuating an outlet valve of the pressure container, the handle assembly comprising:

a) a base having a pressure container engaging portion for retaining the base relative to the pressure container;

b) a handle pivotally connected to the base on a pivot axis and movable between at least a first orientation relative to the base and a second orientation relative to the base, the handle including a grip for grasping by a user to manipulate the handle relative to the pressure container, a nozzle and a dispensing button connected to the outlet valve for selectively opening the outlet valve to pass pressurized contents from the pressure container and through the nozzle; and c) the dispensing button includes a cam and further comprising an elbow connected to the pressure container, the elbow including a cam follower for contacting the cam.

10. The handle assembly of claim 9, wherein the cam and the cam follower are selected to provide constant actuation of the outlet valve independent of orientation of the handle relative to the base.

11. A handle assembly for engaging a pressure container and selectively actuating an outlet valve of the pressure container, the handle assembly comprising:

a) a base having a pressure container engaging portion for retaining the base relative to the pressure container;

b) a handle pivotally connected to the base on a pivot axis and movable between at least a first orientation relative to the base and a second orientation relative to the base, the handle including a grip for grasping by a user to manipulate the handle relative to the pressure container, a nozzle and a dispensing button connected to the outlet valve for selectively opening the outlet valve to pass pressurized contents from the pressure container and through the nozzle: and c) a finger guard extending from the handle a sufficient distance to locate a finger of a user intermediate the finger guard and an underside of the handle during operation of the handle assembly.

12. A handle assembly for a pressure container comprising:

a) a base having a portion engagable with the pressure container to retain the base relative to the pressure container;

b) a handle pivotally connected to the base on a pivot axis for movement about the pivot axis between at least a first and a second adjusted position relative to the base and the engaged pressure container;

c) the handle having a grip for grasping by a user to lift the pressure container and to move the handle about the pivot axis between the first and second adjusted positions; and (d) the handle including a nozzle and a dispensing button on the handle connected to an outlet valve of the pressure container the dispensing button selectively opening the outlet valve independent of the first and second adjusted position of the handle to pass pressurized contents from the pressure container and through the nozzle.

* * * * *